US010043493B2

(12) United States Patent
Loo et al.

(10) Patent No.: US 10,043,493 B2
(45) Date of Patent: Aug. 7, 2018

(54) DRIVE METHOD AND SYSTEM FOR LED DISPLAY PANEL

(71) Applicant: The Hong Kong Polytechnic University, Kowloon (HK)

(72) Inventors: Ka Hong Loo, Kowloon (HK); Yuk Ming Lai, Kowloon (HK); Chi Kong Michael Tse, Kowloon (HK)

(73) Assignee: The Hong Kong Polytechnic University, Hunghom, Kowloon (HK)

( * ) Notice: Subject to any disclaimer, the term of this patent is extended or adjusted under 35 U.S.C. 154(b) by 159 days.

(21) Appl. No.: 14/781,365

(22) PCT Filed: Mar. 27, 2014

(86) PCT No.: PCT/CN2014/074203
§ 371 (c)(1),
(2) Date: Dec. 18, 2015

(87) PCT Pub. No.: WO2014/161443
PCT Pub. Date: Oct. 9, 2014

(65) Prior Publication Data

US 2016/0118026 A1 Apr. 28, 2016

(30) Foreign Application Priority Data

Apr. 1, 2013 (CN) ..... 2013 1 0111015

(51) Int. Cl.
*G09G 1/00* (2006.01)
*G09G 5/399* (2006.01)
(Continued)

(52) U.S. Cl.
CPC ..... *G09G 5/399* (2013.01); *G09G 3/2014* (2013.01); *G09G 3/2096* (2013.01); *G09G 3/32* (2013.01);
(Continued)

(58) Field of Classification Search
CPC .... G09G 5/399; G09G 3/2014; G09G 3/2096; G09G 3/32; G09G 3/3275; G09G 3/3283; H05B 33/0827; H05B 33/086
See application file for complete search history.

(56) References Cited

U.S. PATENT DOCUMENTS

2002/0153456 A1* 10/2002 Yerge ..... B61L 3/24 246/34 CT
2003/0117382 A1* 6/2003 Pawlowski ..... G09G 5/005 345/204
(Continued)

FOREIGN PATENT DOCUMENTS

CN 101950548 A 1/2011
CN 102148010 A 8/2011
(Continued)

OTHER PUBLICATIONS

Xu, Huifeng; Wang, Jingcun; "Design of LED Video Displayer Control System Based on FPGA", Video Engineering, vol. 34, No. S2, Dec. 31, 2010 (Dec. 31, 2010), ISSN: p. 1, paragraph 2 to p. 3, the last paragraph.
(Continued)

*Primary Examiner* — Sejoon Ahn
(74) *Attorney, Agent, or Firm* — Barlow, Josephs & Holmes, LTD.

(57) ABSTRACT

A drive method and system for an LED display panel. The method comprises: converting an HDMI/DVI video signal into an RGB signal; dividing the RGB signal into N independent code streams and re-ranking same; and periodically switching a direct current provided to an LED display module (30) at least between a first current $I_1$ and a second current $I_2$. The system comprises an FPGA controller (20), and a video signal decoder (10), a first external memory (41), a second external memory (42) and an LED display module (30) which are respectively connected to the FPGA
(Continued)

controller (20). The FPGA controller (20) comprises N LED drive modules (231-23N) which are connected in parallel. The drive method and system can enhance the luminous efficacy of an LED, and can also conduct linear dimming on the LED.

8 Claims, 10 Drawing Sheets

(51) Int. Cl.

| | |
|---|---|
| ***G09G 3/32*** | (2016.01) |
| ***G09G 3/20*** | (2006.01) |
| ***H05B 33/08*** | (2006.01) |
| ***G09G 3/3275*** | (2016.01) |
| ***G09G 3/3283*** | (2016.01) |

(52) U.S. Cl.
CPC ..... *G09G 3/3275* (2013.01); *G09G 3/3283* (2013.01); *H05B 33/086* (2013.01); *H05B 33/0827* (2013.01); *G09G 2310/0286* (2013.01); *G09G 2310/0297* (2013.01); *G09G 2330/021* (2013.01); *G09G 2360/12* (2013.01); *G09G 2360/18* (2013.01); *G09G 2370/12* (2013.01)

(56) References Cited

U.S. PATENT DOCUMENTS

| | | | | |
|---|---|---|---|---|
| 2004/0130669 | A1* | 7/2004 | Shin | H04N 5/74 348/744 |
| 2008/0143747 | A1* | 6/2008 | Morgan | G09G 3/2022 345/629 |
| 2010/0045690 | A1* | 2/2010 | Handschy | G09G 3/3629 345/549 |

FOREIGN PATENT DOCUMENTS

| | | | |
|---|---|---|---|
| CN | 102159002 | A | 8/2011 |
| CN | 102821515 | A | 12/2012 |
| KR | 20090109323 | A | 10/2009 |

OTHER PUBLICATIONS

Xu, Huifeng: "Design of LED Video Displayer Control System Based on FPGA", Electronic Technology & Information Science, vol. 1136-39, pp. 3-5, 7-13 and 17-20, Feb. 29, 2012 (Feb. 29, 2012).

* cited by examiner

DRIVE METHOD AND SYSTEM FOR LED DISPLAY PANEL

TECHNICAL FIELD

The present invention relates to LED display panels, and more particularly, to a drive method and a system for the enhancement of the luminous efficiency of a LED display panel.

BACKGROUND

A LED array is the main power consumption part of an outdoor LED display panel having a large display area and high power consumption. Therefore, there exists the need to enhance the luminous efficiency of a LED array so as to reduce the power consumption of the outdoor LED display panel.

The luminous efficiency of a LED array is mainly dependent on LED drive modes. The common modes of LED drive can be roughly classified into two categories: analog or direct current (DC) and switch pulse width modulation (PWM). When using either analog or direct current (DC) drive modes, a LED array has the highest luminous efficiency and the optimal color stability. However, the illumination output of a LED array varies nonlinearly, so that it is unable to dim linearly, which makes the lighting output unstable. When using the switch pulse width modulation mode, two direct currents are periodically switched to supply the LED. One of the direct currents is zero, commonly referred to as the low level direct current, and the other direct current is greater than zero, commonly referred to as the high level DC current. By adjusting the duration of the high level direct current, the effective value of the power supply current can be adjusted, and then the illumination output of a LED is adjusted. However, this kind of drive mode causes the luminous efficiency of a LED to be reduced.

SUMMARY OF THE INVENTION

The present invention provides a drive method and a system for a LED display panel that can enhance the luminous efficiency of the LED display panel and also permits linear dimming of the LED display panel, addressing the above-mentioned drawbacks of existing LED drive modes which have nonlinear lighting output and lower luminous efficiency.

In one aspect, the present invention provides a drive method for a LED display panel, wherein the method comprises:

S1. Converting a HDMI/DVI video signal into an RGB signal by using a video signal decoder, and transmitting the RGB signal in parallel with a synchronous signal and a clock signal to a FPGA controller;

S2. Dividing the RGB signal into N independent code streams by using a FPGA controller, and after re-ranking, storing them in an external memory;

S3. Using N parallel LED drive modules to provide a direct current for the LED display panel, and periodically switching the direct current provided by N parallel LED drive modules at least between a first current $I_1$ and a second current $I_2$; simultaneously using the N parallel LED drive modules correspondingly to receive the re-ranked N independent code streams, and adjusting the duty cycle of the direct current provided by the N parallel LED drive modules according to the re-ranked N independent code streams to keep the average current provided by the N parallel LED drive modules at a given current value $I_{DC}$.

Preferably, in step S2, the FPGA controller stores the RGB signal into the external memory by using a ping-pong buffering method, and then divides the stored RGB signal into the N independent code streams.

Preferably, in step S2, the FPGA controller re-ranks the N independent code streams by using a bit-plane separation strategy in a digital video signal.

It is preferred to take N as a natural number greater than or equal to 2, when N is equal to 2, the first current $I_1$ is greater than zero, and the peak value of the second current $I_2$ is twice that of the first current $I_1$, for generating the maximum illumination output set by the LED display module.

Preferably, the current value $I_{DC}$ is determined by the RGB signal and the maximum illumination output set by the LED display module.

Another technical solution of the present invention is to provide a drive system for a LED display panel, wherein the system comprises a FPGA controller, and a video signal decoder, a LED display module and at least two external memories, which are connected with the FPGA controller, respectively, and the FPGA controller comprises N parallel LED drive modules, wherein:

the video signal decoder for converting a HDMI/DVI video signal into an RGB signal, and then transmitting the RGB signal in parallel with a synchronous signal and a clock signal to the FPGA controller;

the FPGA controller for dividing the RGB signal into N independent code streams, and after re-ranking, storing them in the external memories;

the N parallel LED drive modules for receiving the re-ranked N independent code streams, and outputting at least a first current $I_1$ and a second current $I_2$ to the LED display module, wherein the N independent code streams used for adjusting the duty cycle of the current outputted by the N parallel LED drive modules to keep the average current outputted by the N parallel LED drive modules at a given current value $I_{DC}$.

Preferably, the FPGA controller further comprises a data receiving module and a data partitioning module, wherein the data receiving module used for storing the RGB signal into the external memory with a ping-pong buffering method, and the data partitioning module used for dividing the stored RGB signal into the N independent code streams.

Preferably, the FPGA controller further comprises a bit-plane separation module, wherein the bit-plane separation module used for re-ranking the N independent code streams by using a bit-plane separation strategy in a digital video signal.

It is preferred to take N as a natural number greater than or equal to 2, when N is equal to 2, the first current $I_1$ is greater than zero, and the value of the second current $I_2$ is twice that of the first current $I_1$, for generating the maximum illumination output set by the LED display module.

Preferably, the current value $I_{DC}$ is determined by the RGB signal and the maximum illumination output set by the LED display module.

In the implementation of the drive method and system of the present invention, the multi-level pulse width modulation mode is applied to a drive method of a LED display panel, and when N is equal to 2, the low current level is set as a half of the high current level, which enhances the luminous efficiency of the LED display panel and also conducts linear dimming on the LED display panel.

BRIEF DESCRIPTION OF THE DRAWINGS

The present invention is further described by incorporation with the accompanying drawings and the embodiments as below.

DETAILED DESCRIPTION OF THE EMBODIMENTS

The present invention is related to a drive method and system of a LED display panel which applies a multi-level pulse width modulation mode to the drive process of a LED display panel. A multi-level pulse width modulation mode is an extension of a switch pulse width modulation mode, which is free to choose, according to dimming needs of a LED display panel, at least two or at least a pair of direct currents that need to be switched periodically and to be provided to a LED display module among the multi-pair or multiple direct currents, rather than to be switched between two extreme states (complete turn-off and turn-on). By adjusting at least two direct currents that are switched periodically, the LED luminous efficiency can be enhanced to the utmost, but at the same time, light dimming will tend to nonlinear. Therefore, when using multi-level pulse width modulation mode to drive LED display panel, a balance point between the dimming linearity and the luminous efficiency should be found. That means choosing a proper "direct current pair" for switching, and adjusting the direct current pair, for example, by adjusting the duty cycle of the bigger current value or adjusting the duty cycle of the output direct current so that the average current value is fixed at a predetermined value, such that the luminous efficiency of LED display panel is enhanced and the linear dimming is maintained.

Figure 1:
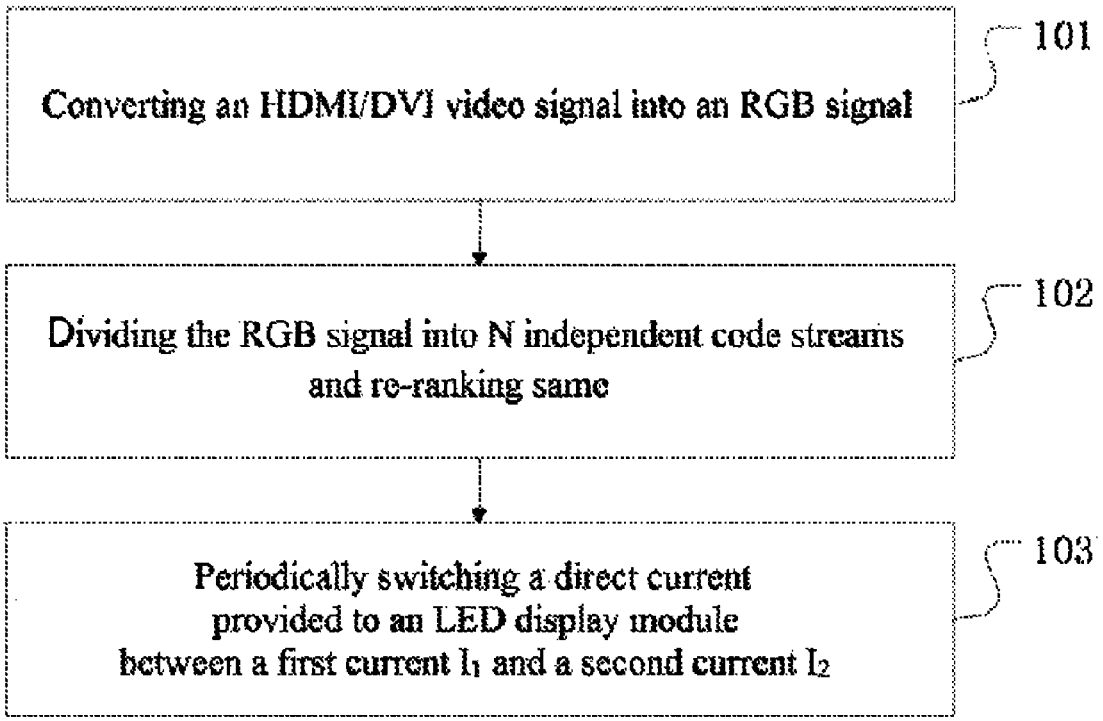
FIG. 1 is a flow diagram of an embodiment of a drive method of the present invention.

As shown in FIG. 1, the drive method 100 of a LED display panel of an embodiment of the present invention comprises the following steps:

In step 101, a video signal decoder converts a HDMI/DVI video signal into an RGB signal, and the RGB signal in parallel with a synchronous signal and a clock signal is transmitted to a FPGA controller, wherein the RGB signal is a 24-bit RGB signal, and the intensity of each color video signal is coded with 8-bit digits, so that each color's grayscale is 256.

In step 102, the FPGA controller divides the RGB signal into N independent code streams, and after re-ranking, they are stored in an external memory.

Wherein, N is the number of the LED drive modules, $I_{DC}$ is the required average current value corresponding to the grayscale represented by the original RGB signal. First current $I_1$ is the low level current value from the "direct current pair" selected by multi-level pulse current corresponding to $I_{DC}$, and the second current $I_2$ is the high level current value from the "direct current pair" selected by multi-level pulse current corresponding to $I_{DC}$.

In this step, firstly, the FPGA controller stores the RGB signal from a video decoder into the memory by using the ping-pong buffering, and then divides the stored RGB signal into N independent code streams (data string), and re-ranks the N independent code streams into the signals that are compatible with the LED drive modules. The FPGA controller re-ranks the N independent code streams by using bit-plane separation strategy in digital video signals. The N independent code streams in this step correspond to N parallel LED drive modules, respectively, where one independent code stream is loaded on one LED drive module. Furthermore, by correspondingly adjusting the duty cycle of the second current $I_2$, the average current is maintained at a given current value $I_{DC}$, and meanwhile the luminous efficiencies of the LED display modules are enhanced. The current value $I_{DC}$ is determined by the RGB signal and the maximum illumination output that is set by the LED display module.

In step 103, the N parallel LED drive modules correspondingly receive the N independent code streams that have been re-ranked, and the direct current provided to the LED display modules is periodically switched at least between the first current $I_1$ and the second current $I_2$, preferably, wherein the first current $I_1$ is greater than or equal to zero and the second current $I_2$ is greater than the first current $I_1$. The pair of currents $I_1$ and $I_2$ switched periodically in this step is selected in advance from N pairs of electric currents according to the basic principle of the maximum LED luminous efficiency. The N pairs of electric currents are 0 and $I_1$, $I_1$ and $I_2$, $I_3$ and $I_4$, . . . , $I_{N-1}$ and $I_N$. The specific selection method refers to "tri-level drive scheme".

In another embodiment of the present invention, W pairs of currents (W is greater than or equal to 2) or Q currents (Q is greater than or equal to 3) are chosen from N pairs of currents to conduct periodical switching. The specific selection method refers to "tri-level drive scheme".

The N in this step is a natural number greater than or equal to 2. If N is equal to 2, the multi-level pulse width modulation of the present invention is tri-level pulse width modulation, of which three levels are 0, $I_1$ and $I_2$, respectively. Herein, the second current $I_2$ is determined by the maximum illumination output that is set by the LED display module. N parallel LED drive modules are corresponding to N+I level pulse width modulation.

Figure 2:
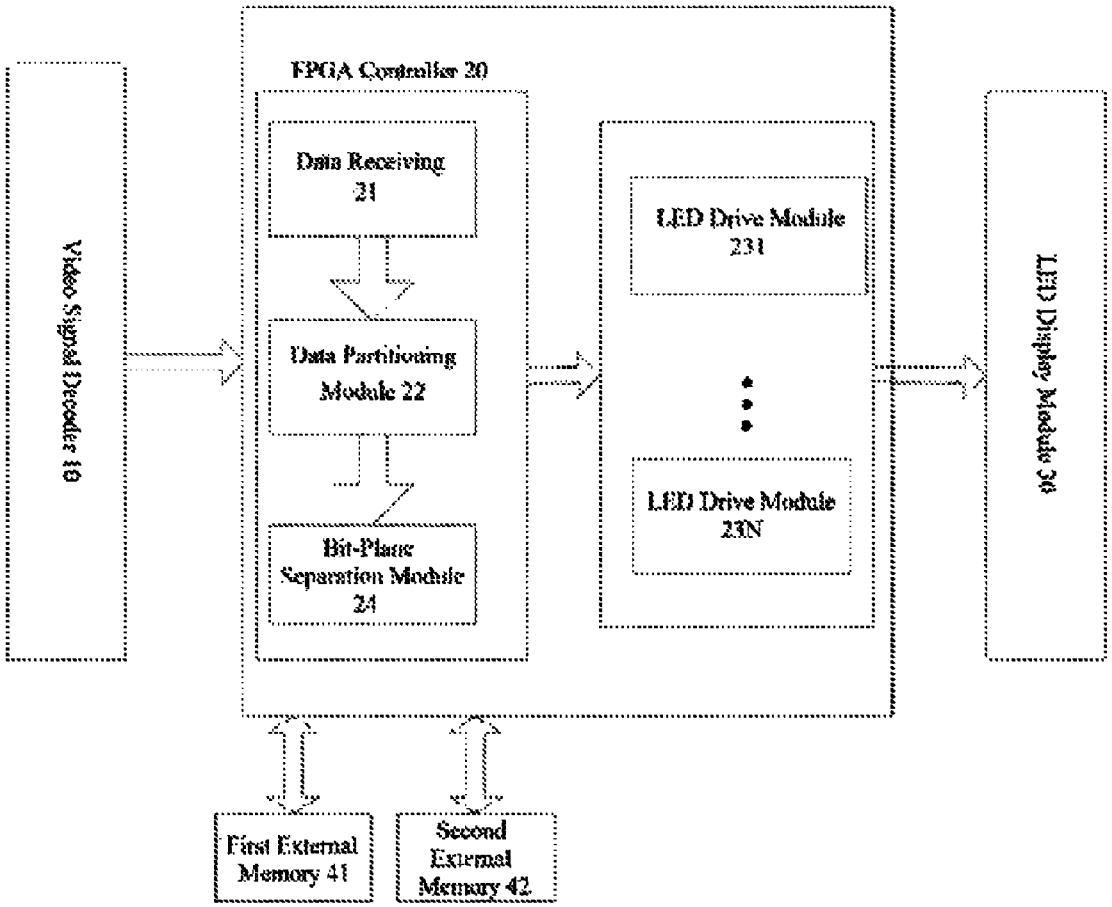
FIG. 2 is a structure diagram of an embodiment of a drive system of the present invention.

As shown in FIG. 2, the drive system of an embodiment of a LED display panel according to the present invention comprises a FPGA controller 20, and a video signal decoder 10, a first external memory 41, a second external memory 42 and a LED display module 30 which are in communication connection with the FPGA controller 20, respectively, in which the FPGA controller 20 comprises N parallel LED drive modules 231-23N, and further comprises a data receiving module 21, a data partitioning module 22 and a bit-plane separation module 24, wherein:

the video signal decoder 10, for converting a HDMI/DVI video signal into a RGB signal, and then transmitting the RGB signal in parallel with a synchronous signal and a clock signal to the FPGA controller 20;

the FPGA controller 20, for conducting the read and write, and re-ranking of the RGB signal, in which the RGB signal is firstly received, and is stored into the first external memory 41 or the second external memory 42, and then the stored RGB signal is divided into N independent code streams, of which the data receiving module 21 is used for storing the received RGB signal into the first external memory 41 and the second external memory 42 with ping-pong buffering method, the data partitioning module 22 is used for dividing the stored RGB signal into N independent code streams, the bit-plane separation module 24 is used for re-ranking the N independent code streams into the signals compatible with N parallel LED drive modules;

the N parallel LED drive modules 231-23N, for correspondingly receiving the re-ranked N independent code streams, and outputting current to the LED display module 30 under the control of N independent code streams. The multi-level pulse current synthesized under the control of N independent code streams will fluctuate at least between the first current $I_1$ and the second current $I_2$, the first current $I_1$ is greater than or equal to zero, and the second current $I_2$ is greater than the first current $I_1$.

Figure 3:
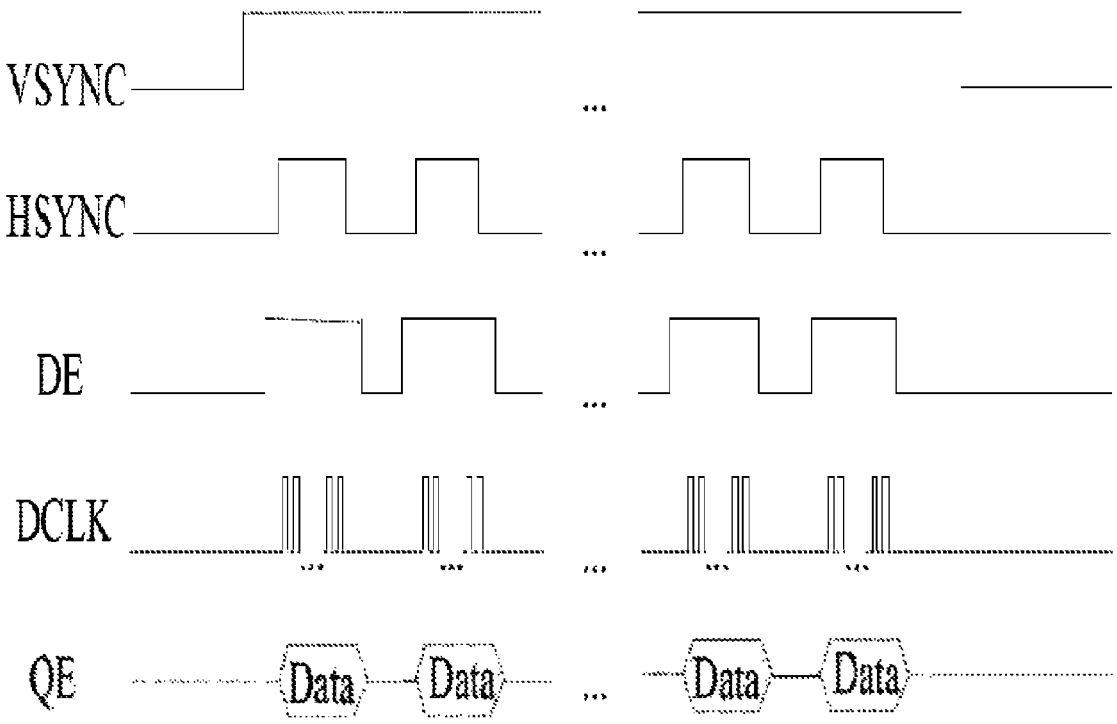
FIG. 3 is a waveform diagram of an embodiment of an output signal from the video decoder in FIG. 2.

In an embodiment of the present invention, the timing sequence chart of signals transmitted by the video signal decoder 10 to the FPGA (field-programmable gate array) controller 20 is shown in FIG. 3.

Synchronization signal mainly comprises an output data enable (DE), a vertical sync output (VSYNC) and a horizontal sync output (HSYNC). DCLK refers as an output data clock, and QE refers as a data stream of a RGB signal.

The rising edge of a VSYNC indicates a scanning process of a field of LED display panel. The duration of the scanning process refers as a duration of the high pulse of a VSYNC. The rising edge of a HSYNC indicates a line scanning (or a column scanning) process. In the process of column scanning, a DCLK is a pixel counter that is used for the data amount of sending to the FPGA controller and the LED display module according to the panel size. For example, corresponding to n pixels on a panel of size m×n, n clock pulses are employed to transmit data.

Figure 4:
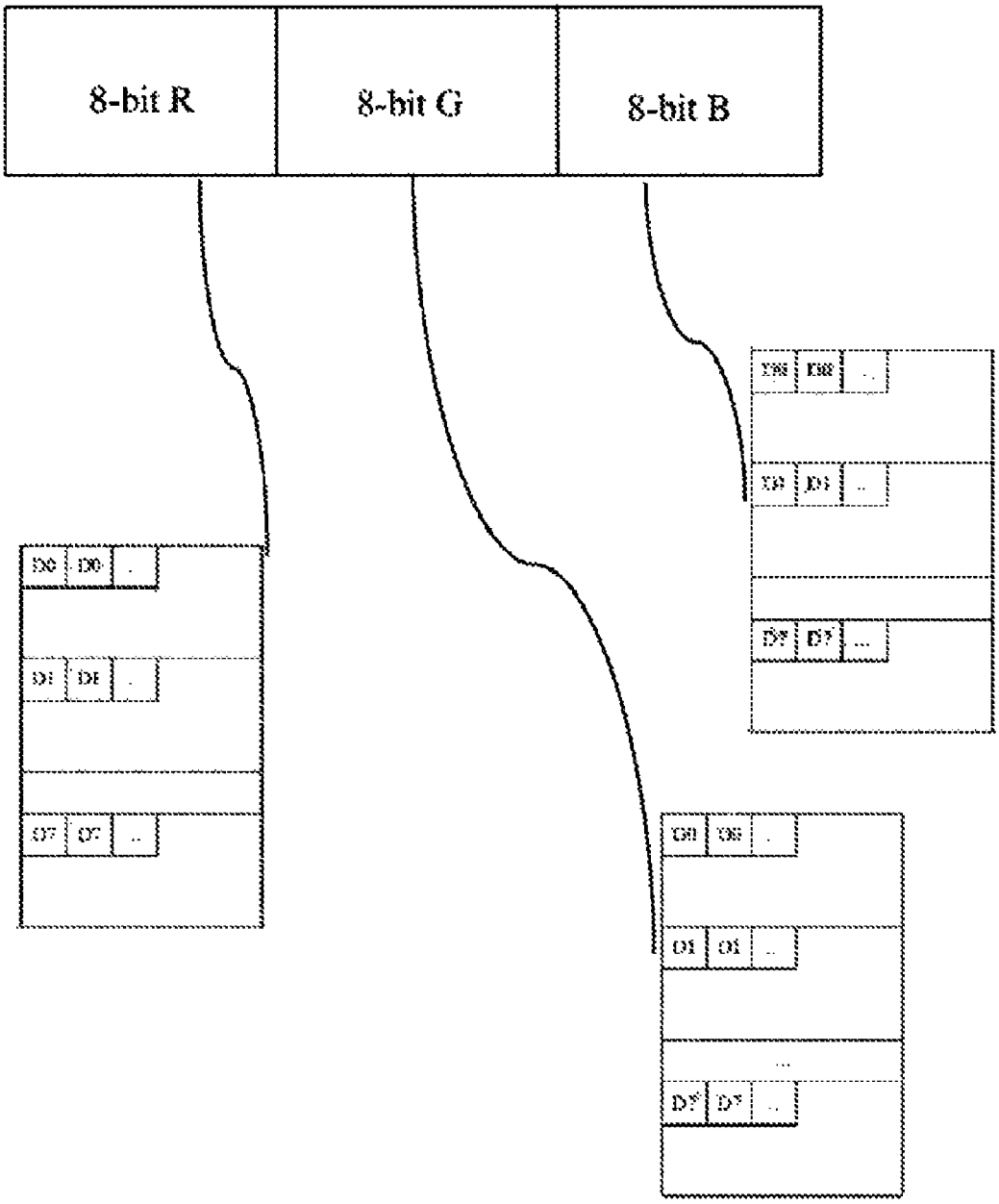
FIG. 4 is a flow diagram of re-ranking the RGB signal in step 102 shown in FIG. 1.

In an embodiment of the present invention, the FPGA controller 20 re-ranks the N independent code streams to make it compatible with the LED drive module. The present invention can use a re-ranking method as shown in FIG. 4. The FPGA 20 firstly read the received 24-bit RGB signal into two external memories (RAM) by using the ping-pong buffering method. The minimum storage capacity of each RAM should be sufficient to store the data corresponding to a complete field. As an example, for a panel of size m×n, the required internal storage space is m×n×24 bits=3 mn bytes. With the ping-pong buffering method, two RAM alternately conduct reading and writing to ensure that the data from the video signal decoder 10 is not interrupted.

Subsequently, FPGA controller 20 also divides the RGB signal stored in RAM into N independent code streams (RGB sub-signal), and then re-ranks the RGB signal to make the re-ranked RGB sub-signal compatible with LED drive module. In this embodiment, the re-ranking mechanism can adopt the bit-plane separation method as shown in FIG. 4. In the bit-plane separation method, the R, G, and B are red, green and blue of three true color image data, respectively, of which each takes up one byte, eight bits. After the bit-plane separation acts on the data, the equal weight bits of different data constitute new data. By controlling the address of the memory, equal weight bits of all data of one frame is written in the same segment of memory. The LED display panel requires 256 grayscales, so the external memory is divided into eight segments (D0-D7), of which each segment stores the bits representing the same weight value. This re-ranking method with bit-plane separation will simplify the LED drive module. For instance, if scanning one line needs a time T, the first bit stored in D7 will lead the corresponding LED pixels in the line to be activated for the duration of 128T/256, while the first bit stored in D0 will lead the corresponding LED pixels in the line to be activated for the duration of 1T/256. Therefore, it is not necessary to convert data bits to the corresponding PWM duty cycle or to use a D/A converter. The same overall activation time can be achieved in the form of distribution or binary weight. Thus, in the same line of the LED display panel, all the LED pixels will not be activated at the same time, and which also avoids the power source of the LED display panel having a huge transient load change.

Figure 5:
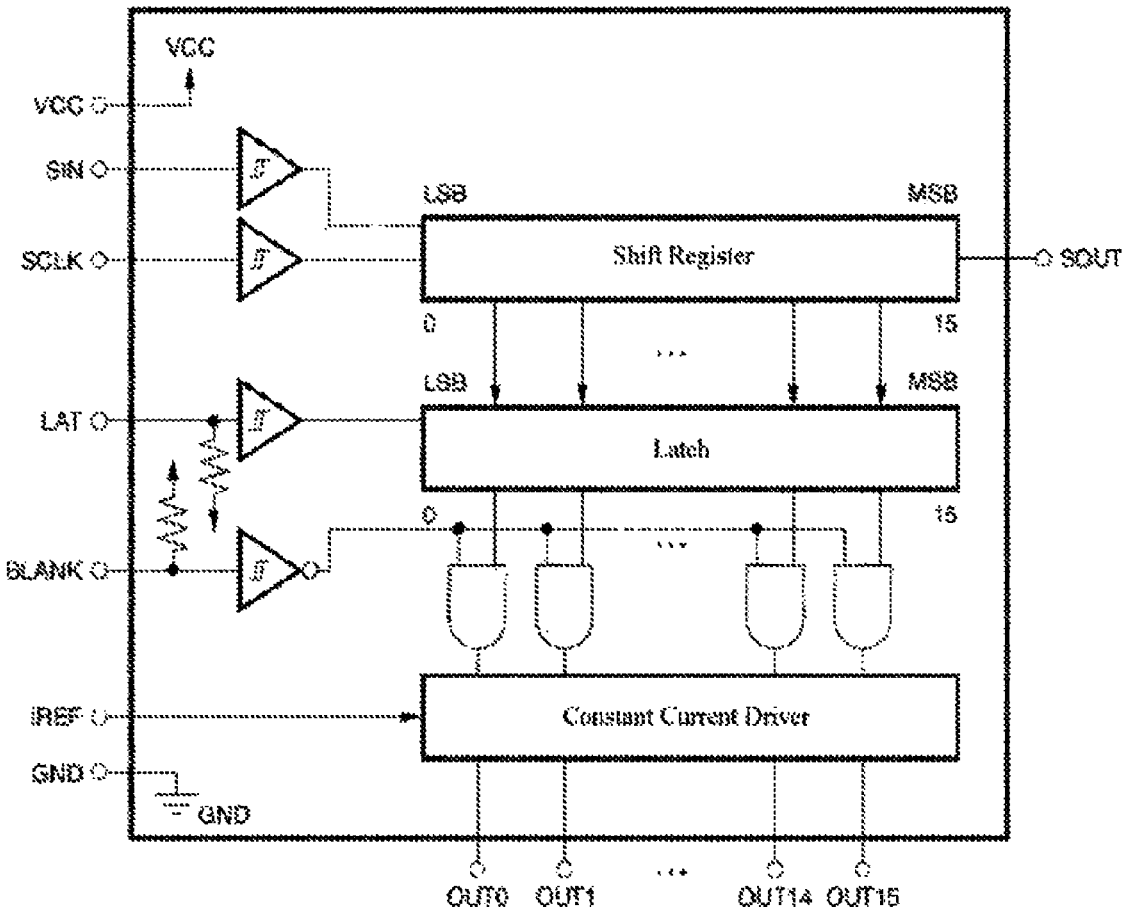
FIG. 5 is a circuit structure diagram of a LED drive module shown in FIG. 2.

FIG. 5 is a circuit diagram of LED drive module in the preferred embodiment of the present invention. As shown in the Figure, the LED drive module 231 comprises a 16-bit shift register (flash memory) to receive the serial data transmitted via FPGA controller 20. FPGA controller 20 in advance reads 16 equal weight data corresponding to 16 pixel points from a pile of data (constituted after bit-plane separation) stored in the external memory 41 or 42. Then the converted data are transmitted with 16 clock pulses to the LED drive module 231. If the LED display panel is provided with more than 16 pixels per line, it is required to cascade multiple LED drive modules 231-23N, and FPGA controller will continue to transmit data strings until all of the data bits of the shift registers are filled.

Figure 6:
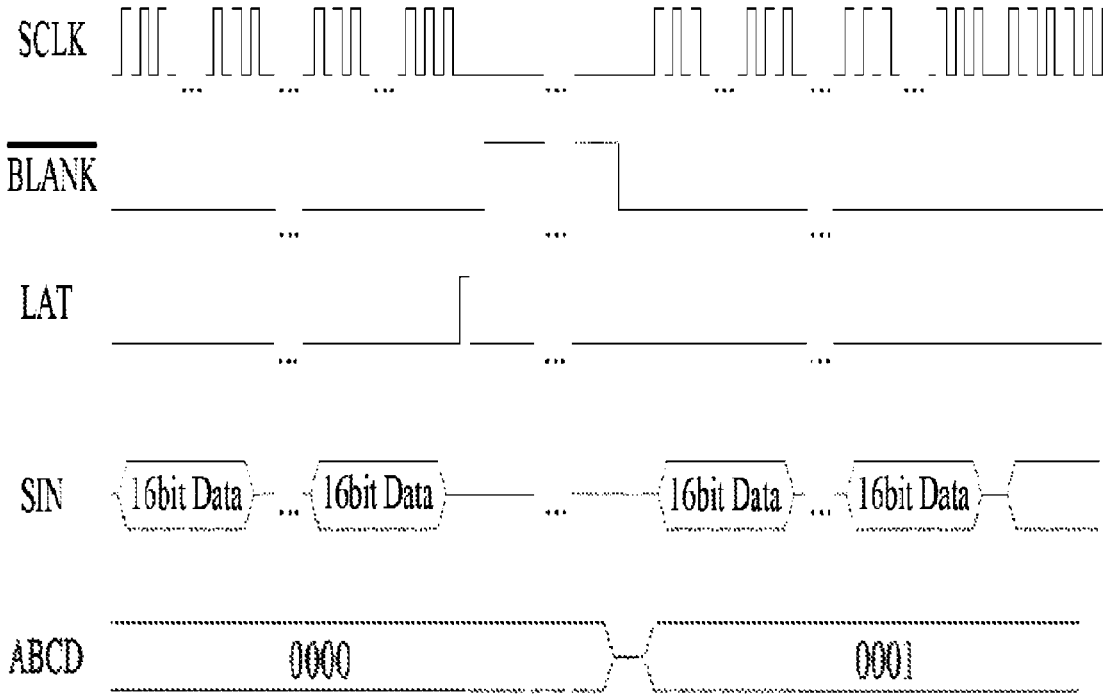
FIG. 6 is a waveform diagram of an embodiment of the control signals of the LED drive module in FIG. 5.

After the transmission of all of the data bits corresponding to one line is finished, a LAT pulse in FIG. 6 shifts to the rising edge, and the latch of LED drive module 231 will read the data from a shift register and latch them (once latched, the shift register can begin to accept the data of the next weight value in the same line, and meanwhile the latch can independently activate the LED). Then, the constant current driver works during a time interval, which is the time duration for BLANK pulse in FIG. 6 keeping at falling edge and corresponds to the weight value of the corresponding stored data bits. This process is repeated until all of the eight groups of data bits (eight groups of data with different weight values) is transmitted to the LED drive module 231. Afterwards, the input value of a line decoder (the ABCD in FIG. 6) increase a value, and at the same time, the transmission for data bits of next line will start, and the LED pixel point of the next line is lit by the same way.

Figure 7:
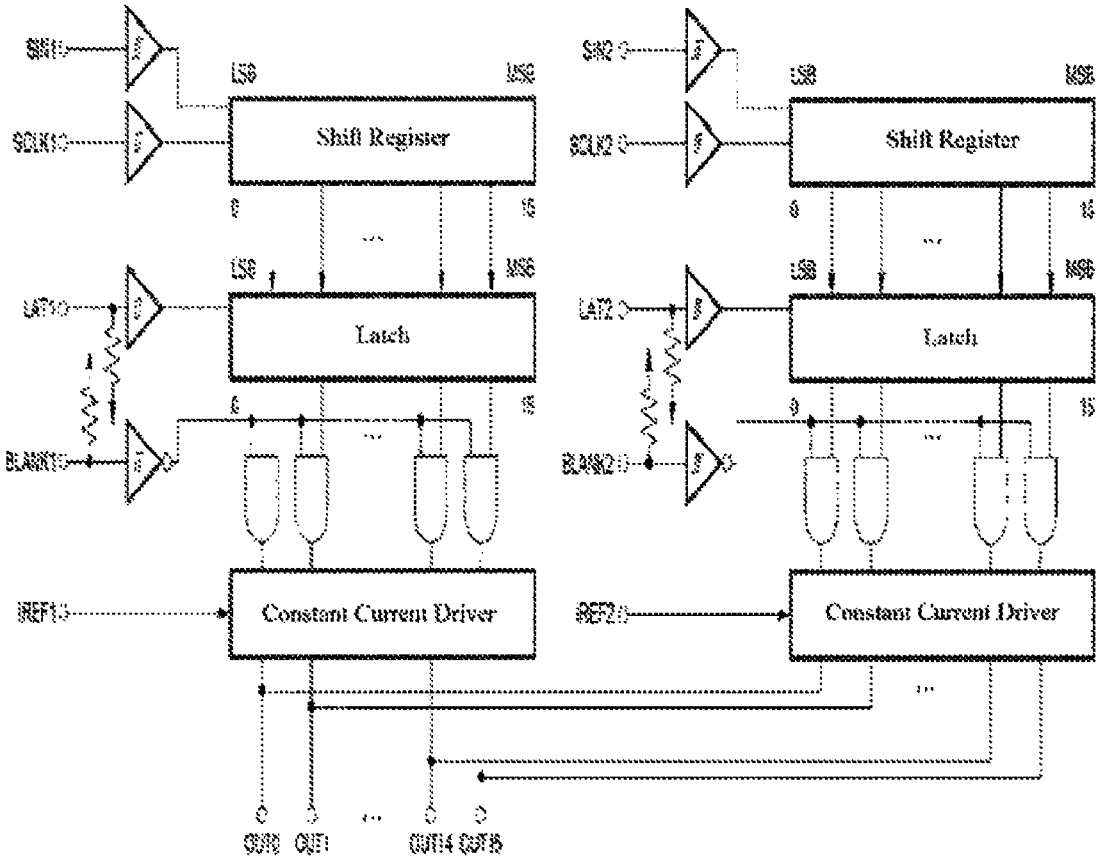
FIG. 7 is a circuit structure diagram of two parallel LED drive modules shown in FIG. 2.

FIG. 7 shows a circuit diagram of two parallel LED drive modules, but the present invention is not limited to two parallel drive modules as shown in FIG. 7. The FPGA controller 20 of the embodiment of the present invention comprises at least two parallel LED drive modules 231-23N.

Figure 8:
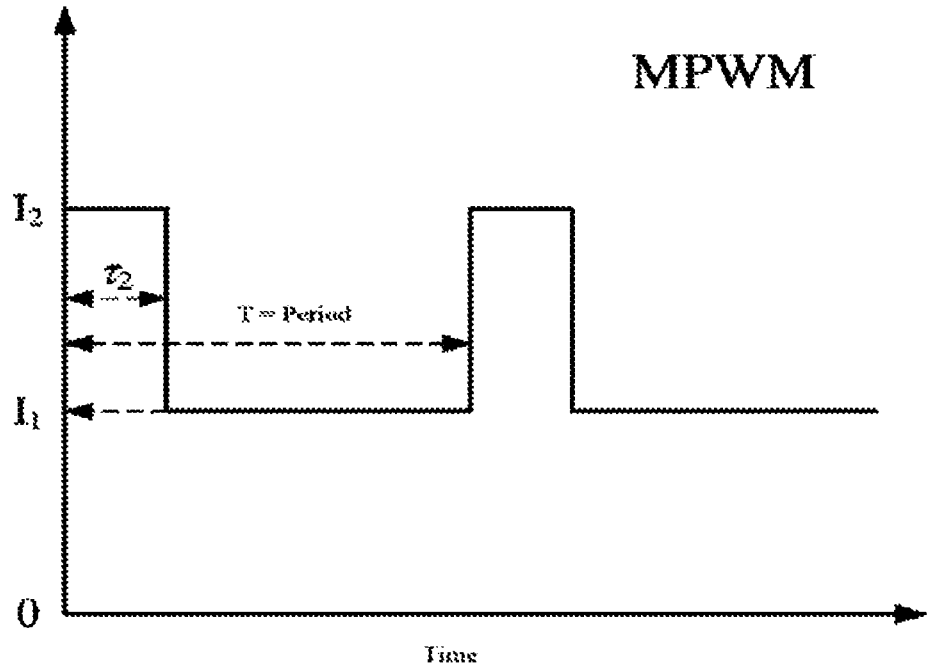
FIG. 8 is a current waveform graph of a drive method of multi-level pulse width modulation of the present invention.
Figure 9:
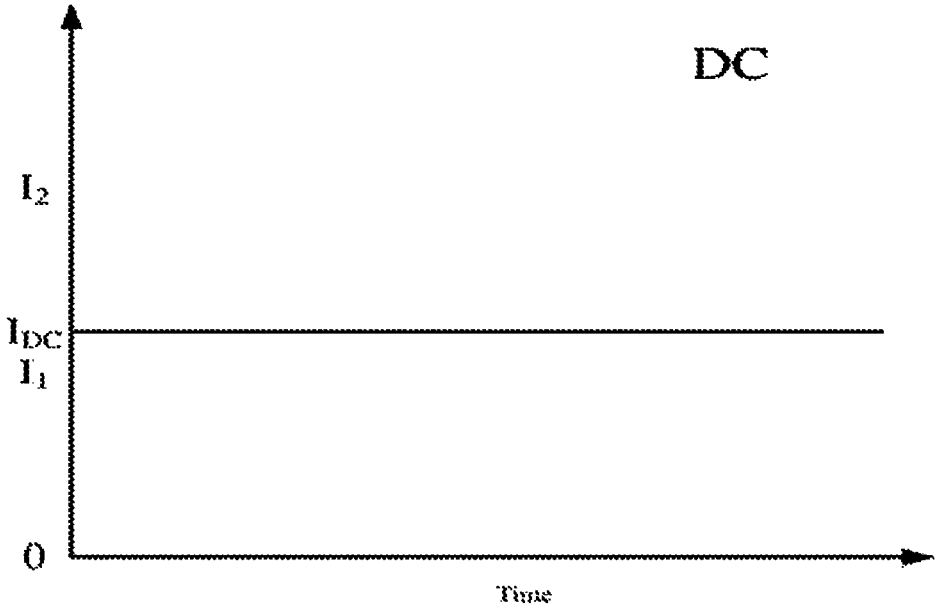
FIG. 9 is a current waveform graph of a direct current drive method in prior art.
Figure 10:
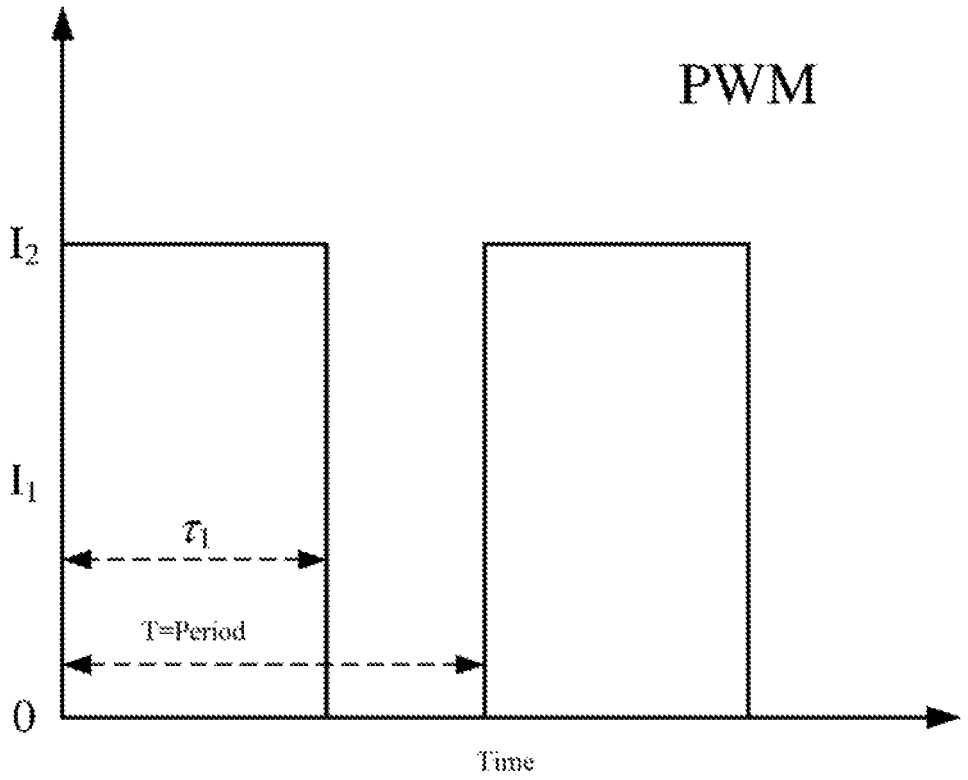
FIG. 10 is a current waveform graph of a drive method of pulse width modulation in prior art.

FIGS. 8-10 are the typical waveform graphs of the currents of three kinds of drive methods, of which DC denotes direct current drive method, PWM denotes pulse width modulation drive method, and MPWM denotes multi-level pulse width modulation drive method. In the Figures, the average currents of the three kinds of drive methods are equal, i.e. $I_{DC}$. In this embodiment, $I_1<I_{DC}<I_2$, the duration time of the high level current $I_2$ (the second current) of the multi-level pulse width modulation mode is $\tau_2$, the corresponding average current is expressed as follows:

$$I_{DC} = \left(\frac{\tau_2}{T}\right)I_2 + \left(\frac{T-\tau_2}{T}\right)I_1 = I_1 + \left(\frac{\tau_2}{t}\right)(I_2 - I_1) \quad (1)$$

The main advantage of the multi-level pulse width modulation mode is that it maintains the dimming features of PWM and meanwhile provides relatively high luminous efficiency, so that it is compatible with the digital operational system of a LED display screen. Conversion from one PWM drive signal to multi-level pulse width modulation signal is quite easily achieved by keeping the average currents of two drive signals equal, as shown in the following equation. $\tau_1$ is a duration time of high level current $I_2$ (the second current) under PWM driving.

$$I_{DC} = \left(\frac{\tau_1}{T}\right)I_2 = I_1 + \left(\frac{\tau_2}{T}\right)(I_2 - I_1) \Rightarrow \tau_2 = \left[\frac{(\tau_1/T)I_2 - I_1}{I_2 - I_1}\right]T \quad (2)$$

In theory, by making a multi-level pulse width modulation drive mode as close as possible to the DC drive mode, the LED luminous efficiency can be enhanced to the utmost, which meanwhile makes the dimming process nonlinear. Therefore, at least one pair of proper switching currents must be selected to find out a balance point between the dimming linearity and the luminous efficiency.

Figure 11:
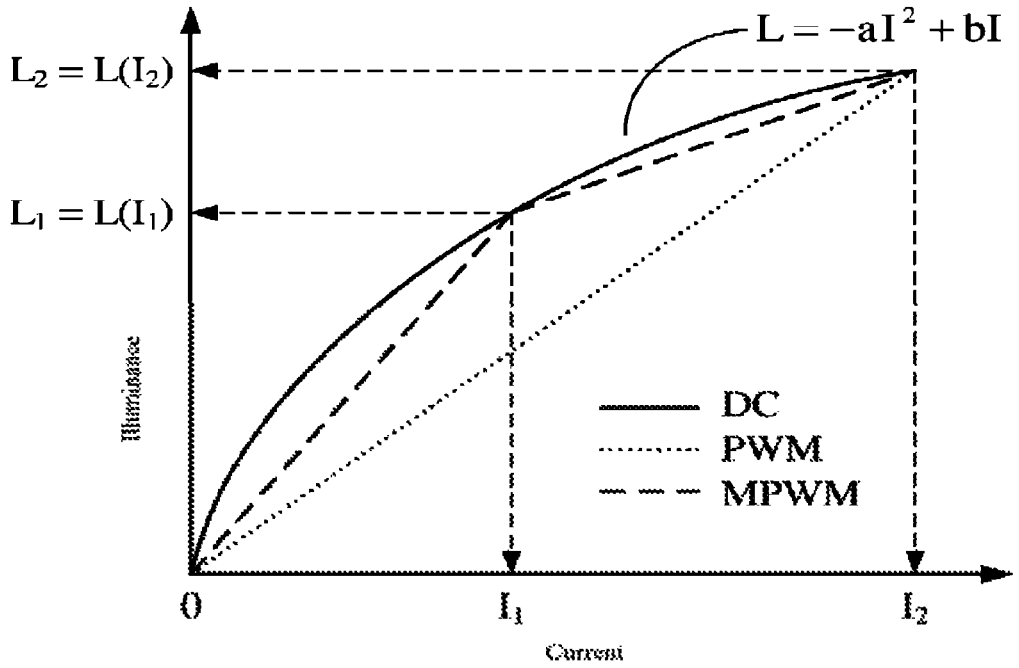
FIG. 11 is the dimming curves with respective to three drive methods in FIGS. 8-10.
Figure 12:
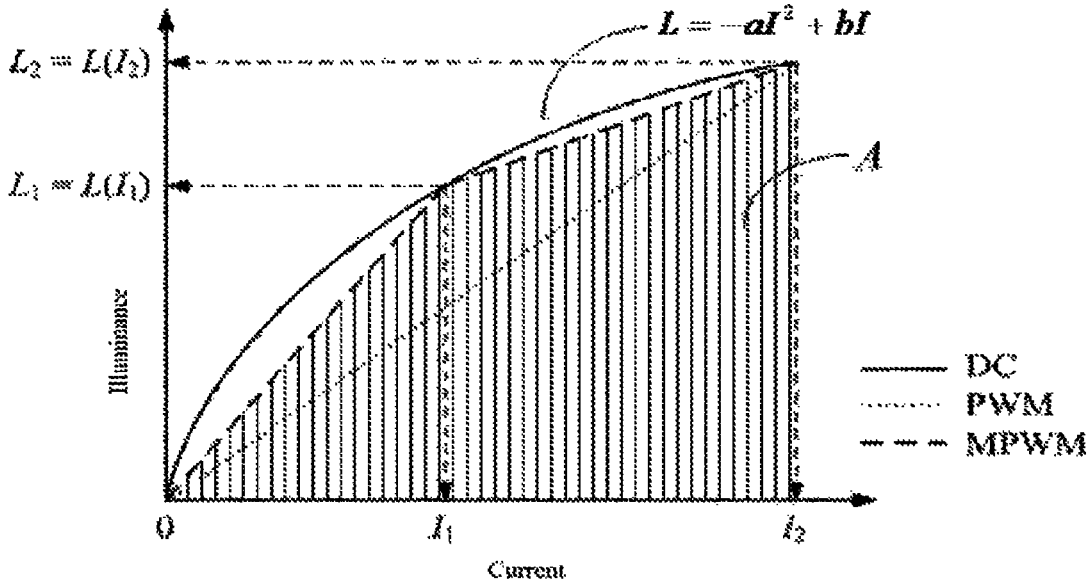
FIG. 12 is a diagram of the maximum luminous efficiency of the LED display module with a MPWM drive method of the present invention.

The embodiment of the present invention based on a tri-level drive scheme discloses the criterion of selecting the first current $I_1$ and the second current $I_2$. At present, the selection of second current $I_2$ is based on the maximum light output of the specified LED display panel, while the lowest current level is always set as zero to make the LED display panel be able to shut down completely, in order to realize the maximum display contrast. The second current $I_2$ is chosen to enhance the luminous efficiency of the LED to the utmost. As shown in FIG. 11 and FIG. 12, the larger the shadow region A, the greater the luminous efficiency of the LED, while the area of shadow region A is as follows:

$$A = \tfrac{1}{2}L_1I_1 + \tfrac{1}{2}(L_1+L_2)(I_2-I_1)$$

$$= \tfrac{1}{2}L_1I_2 + \tfrac{1}{2}L_2(I_2-I_1) \quad (3)$$

Because the illumination output of the LED is of a concave shape, a quadratic function in a standard form as $Y=-ax^2+bx+c$ can be used for fitting, wherein for c=0, the illumination output of the LED is zero, and then the above equation (3) can be further extended to:

$$A = \tfrac{1}{2}(-aI_1^2+bI_1)I_2 + \tfrac{1}{2}(-aI_2^2+bI_2)(I_2-I_1)$$

$$= \tfrac{1}{2}a(I_2^2-I_2^3-I_1^2I_2) + \tfrac{1}{2}bI_2^2 \quad (4)$$

The A is differentiated with respect to the $I_1$ in the above equation, and when the value of the differential equation is set as zero, it can be obtained as $$I_1 = 0.5 \times I_2 \quad (5)$$

In the above derivation process, the equations (1)-(5) are the selection criteria for the first current $I_1$.

The multi-level pulse width modulation drive method can conduct a practical operation on any amount of current levels. In this embodiment, to take the tri-level pulse width modulation as an example, a drive for the LED display panel is carried on. According to the given equation (5), a lower current level $I_1$ is set as 50% of a higher current level $I_1$. By using this setting, the MPWM drive method can be realized in FPGA controller 20 with minimal additional calculation, with no need to add more powerful and extra expensive computing hardware.

By implementing a drive scheme of tri-level pulse width modulation mode, two constant currents are provided to the LED display panel for its drive by connecting two LED drive modules in parallel, but meanwhile, two independent code streams are required to ensure that the average current values is a preset value $I_{DC}$, and the preset value equals to the drive current of the DC drive mode. Two independent code streams are transmitted by the FPGA controller 20, in which the FPGA controller 20 divides the RGB signal into two independent code streams, and then transmits them to the LED drive module 321.

The proposed system configuration in the above embodiment can also be extended to a multi-level pulse width modulation drive (N is greater than or equal to 3). The pair of currents in need of periodical switch is selected according to the required average current $I_{DC}$ that is determined by the original RGB video signals (one of the colors of a pixel). To take three parallel drive module as an example, when $I_{DC}$ is lower than $I_1$, the system selects to work with the pair of currents (0, $I_1$), and the required average currents are achieved by controlling the duty cycle of $I_1$, of which 0 is the first current and $I_1$ is the second current. When $I_{DC}$ is greater than $I_1$ and less than $I_2$, the system selects to work with the pair of currents ($I_1$, $I_2$), and the required average currents are achieved by controlling the duty cycle of $I_2$. When $I_{DC}$ is greater than $I_2$, the system selects to work with the pair of currents ($I_2$, $I_3$), and the required average currents are achieved by controlling the duty cycle of $I_3$, of which $I_2$ is the first current and $I_3$ is the second current.

In the embodiment of a multi-level pulse width modulation drive (N greater than or equal to 3), a periodic switching at two or more current levels can be further used. If the number of periodic switching currents totally used for N drive modules is Q (Q greater than or equal to 3), and then the number of the currents marked in FIG. 11 and FIG. 12 is Q. The region A is composed of 1 triangular region and Q-I trapezoidal regions, the area of the A is the sum area of the 1 triangle region and the Q-I trapezoidal region. The choice criteria of the Q currents are same as that of the above-mentioned two drive modules. However, the number of the periodic switching currents provided to the LED display module by N LED drive module is comprehensively considered on the basis of both the luminous efficiency and the linear dimming of the LED display module. The technical solution can make the luminous efficiency of the LED display module more tending to direct current drive mode, but it reduces the linearity of the linear dimming process of the LED display module at meanwhile.

Moreover, for cost saving, multiple drive units can be integrated into one integrated circuit. The implement of the present drive scheme can save huge energy, and only increase very low hardware cost.

For a signal of each color in a RGB signal, it is required to convert an 8-bit video signal into two 8-bit video sub-signals (code stream) to drive the two LED drive modules. One benchmark for dividing is that the average value of two parallel superposed currents controlled by independent video sub-signals must be equal to the average value of the currents controlled by the original 8 bits video signal. By using the below concrete example for illustration of dividing process of the video signals, as an assumption, the required grayscale (each color) for a given LED pixel is denoted with an 8-bits video signal as [10100000]. If there is only one LED drive module, i.e. PWM for the LED drive mode, whose output level is IREF=$I_2$, then the average current transmitted to each pixel of the LED is $$I_{pixel} = \left(\frac{2^7 + 2^5}{255}\right) I_2 = \left(\frac{160}{255}\right) I_2 = \left(\frac{320}{255}\right) I_1 (\because I_2 = 2I_1) = \left(\frac{255}{255} + \frac{65}{255}\right) I_1 \quad (6)$$

The last line of the equation (6) indicates that the same average currents can be obtained by using two LED drive modules and taking the output level of the each LED drive module as IREF=$I_1$, of which one equivalent binary value is 255/255=[1111 1111], and the other equivalent binary value is 65/255=[0100 0001]. Then, the two 8-bits video sub-signal are re-ranked with the bit plane separation method, and are mapped to different storage regions, and then are transmitted to the two LED drive modules.

From the above discussion of the example, it may be appreciated by a person skilled in the art that, if x is the decimal value of an 8-bit video signal of a kind of LED pixel (each color), then the video signal can be converted into a video signal composed of two 8-bit video sub-signals; If x is less than 128, the two video sub-signals are the original 8-bit video signal and [00000000], respectively; If x is greater than or equal to 128, the two video sub-signals are [1111 1111] and [the binary of (2x-255)], respectively.

If the above method is extended to the usage of (N+I) current levels or N LED drive modules, the video sub-signals can be obtained by the following simple calculation.

1. The (N+I) current levels are arranged in order from small to large, according to the order of 0, $I_1$, $I_2$, $I_3$, . . . , $I_{N+1}$, $I_N$;

2. From the average current $I_{DC}$ controlled by the original 8-bit video signal, both the low level current $I_M$ and the high level current $I_{M+1}$ of the corresponding multi-level pulse currents are determined, in which the determinant conditions are $I_{DC} \geq I_M$ and $I_{DC} < I_{M+1}$;

3. The video sub-signal corresponding to the level equal to $I_M$ or less than $I_M$ is [1111 1111]; the video sub-signal corresponding to the level greater than $I_{M+1}$ is [0000 0000].

4. Finally, by using a simple formula as following, the duty cycle of the high level $I_{M+1}$ is x/255; the video sub-signal corresponding to $I_{M+1}$ is an equivalent binary of x.

$$I_{DC} - I_M = \left(\frac{x}{255}\right)(I_{M+1} - I_M) \Rightarrow \frac{x}{255} = \frac{I_{DC} - I_M}{I_{M+1} - I_M} \quad (7)$$

The above-mentioned is only for the preferred embodiments of the present invention and are not used to limit the present invention. For those skilled in the art, various changes and modifications can be made to the present invention. Any modification, equivalent replacement, improvement and the like that are made within principles of the present invention fall within the scope of claims of the present invention.

What is claimed is:

1. A drive method for a light emitting diode (LED) display panel, wherein the method comprises:

(a) converting a high definition multimedia interface (HDMI) and/or digital visual interface (DVI) video signal into an red, green, and blue (RGB) signal by using a video signal decoder, and transmitting the RGB signal in parallel with a synchronous signal and a clock signal to a field programmable gate array (FPGA) controller;

(b) dividing the RGB signal into N independent code streams by using the FPGA controller, and after re-ranking said N independent code streams, storing said re-ranked N independent code streams in an external memory; and (c) using N parallel direct current LED drive modules to provide a direct current for the LED display panel, and periodically switching the direct current provided by said N parallel direct current LED drive modules at least between a first current $I_1$ and a second current $I_2$; simultaneously using the N parallel direct current LED drive modules correspondingly to receive the re-ranked N independent code streams, and adjusting duty cycle of the direct current provided by the N parallel direct current LED drive modules according to the re-ranked N independent code streams to keep an average current provided by the N parallel direct current LED drive modules at a given current value $I_{DC}$, wherein N is a natural number greater than or equal to 2, when N is equal to 2, the first current $I_1$ is greater than zero, and the peak value of the second current $I_2$ is twice that of the first current $I_1$, for generating a maximum illumination output set by the LED display panel.

2. The drive method for a LED display panel of claim 1, wherein, in step (b) the FPGA controller stores the RGB signal into the external memory by using a ping-pong buffering method, and then divides the stored RGB signal into the N independent code streams.

3. The drive method for a LED display panel of claim 2, wherein, in step (b) the FPGA controller re-ranks the N independent code streams by using a bit-plane separation strategy in a digital video signal.

4. The drive method for a LED display panel of claim 1, wherein the current value $I_{DC}$ is determined by the RGB signal and the maximum illumination output set by the LED display panel.

5. A drive system for a light emitting diode (LED) display panel, wherein the system comprises a field programmable gate array (FPGA) controller; a video signal decoder, a LED display module and at least two external memories, which are connected with the FPGA controller, respectively; and said FPGA controller includes N parallel direct current LED drive modules, wherein the video signal decoder is configured and arranged to convert a high definition multimedia interface (HDMI) and/or digital visual interface (DVI) video signal into an red, green, and blue (RGB) signal, and then transmit the RGB signal in parallel with a synchronous signal and a clock signal to the FPGA controller, wherein the FPGA controller is configured and arranged to divide the RGB signal into N independent code streams, and after said N independent code streams are re-ranked, said re-ranked N independent code streams are stored in the external memories;

wherein the N parallel direct current LED drive modules are configured to receive the re-ranked N independent code streams, and output at least a first current $I_1$ and a second current $I_2$ to the LED display module, wherein the N independent code streams are used to adjust duty cycle of the current outputted by the N parallel direct current LED drive modules to keep an average current outputted by the N parallel direct current LED drive modules at a given current value $I_{DC}$, and wherein N is a natural number greater than or equal to 2, when N is equal to 2, the first current $I_1$ is greater than zero, and the peak value of the second current $I_2$ is twice that of the first current $I_1$, to generate a maximum illumination output set by the LED display panel.

6. The drive system for a LED display panel of claim 5, wherein the FPGA controller further comprises a data receiving module and a data partitioning module, wherein the data receiving module is used for storing the RGB signal into the external memory with a ping-pong buffering method, and the data partitioning module is used for dividing the stored RGB signal into the N independent code streams.

7. The drive system for a LED display panel of claim 6, wherein the FPGA controller further comprises a bit-plane separation module, wherein the bit-plane separation module is used for re-ranking the N independent code streams by using a bit-plane separation strategy in a digital video signal.

8. The drive system for a LED display panel of claim 5, wherein the current value $I_{DC}$ is determined by the RGB signal and the maximum illumination output set by the LED display panel.

* * * * *